US010656586B2

(12) United States Patent
Okamoto

(10) Patent No.: US 10,656,586 B2
(45) Date of Patent: May 19, 2020

(54) IMAGE FORMING APPARATUS

(71) Applicant: Brother Kogyo Kabushiki Kaisha, Nagoya (JP)

(72) Inventor: Yoshihiro Okamoto, Komaki (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 170 days.

(21) Appl. No.: 15/903,123

(22) Filed: Feb. 23, 2018

(65) Prior Publication Data

US 2018/0246458 A1 Aug. 30, 2018

(30) Foreign Application Priority Data

Feb. 28, 2017 (JP) ..... 2017-036037

(51) Int. Cl.

| | |
|---|---|
| ***G03G 15/00*** | (2006.01) |
| ***G03G 15/20*** | (2006.01) |
| ***G03G 15/23*** | (2006.01) |
| ***G03G 21/16*** | (2006.01) |
| ***G03G 21/18*** | (2006.01) |

(52) U.S. Cl.

CPC ..... *G03G 15/6511* (2013.01); *G03G 15/2003* (2013.01); *G03G 15/652* (2013.01); *G03G 21/1604* (2013.01); *G03G 21/1853* (2013.01)

(58) Field of Classification Search

CPC ..... G03G 15/00; G03G 15/20; G03G 15/23; G03G 15/2303; G03G 15/6511; G03G 15/652

See application file for complete search history.

(56) References Cited

U.S. PATENT DOCUMENTS

| | | | | |
|---|---|---|---|---|
| 4,954,849 | A * | 9/1990 | Koike | G03G 15/234 271/3.03 |
| 5,061,962 | A * | 10/1991 | Takahashi | G03G 15/00 399/205 |
| 7,720,409 | B2 * | 5/2010 | Ito | G03G 15/6552 399/107 |
| 2005/0019073 | A1 | 1/2005 | Hattori | |
| 2006/0267269 | A1 | 11/2006 | Yano et al. | |

(Continued)

FOREIGN PATENT DOCUMENTS

| | | | |
|---|---|---|---|
| JP | 2005-041652 | A | 2/2005 |
| JP | 2006-315797 | A | 11/2006 |

(Continued)

*Primary Examiner* — Nguyen Q. Ha

(74) *Attorney, Agent, or Firm* — Burr & Brown, PLLC

(57) ABSTRACT

An image forming apparatus, having feeder tray, a multipurpose tray arranged on a first side surface, a first conveyer path, a second conveyer path, a third conveyer path, and a fourth conveyer path, is provided. A nip position between paired registration rollers is located to be lower than a nip position between a separation roller and a separator member. A tangent that contacts circumferential surfaces of the paired registration rollers at the nip position between paired registration rollers inclines to be lower toward a second side surface opposite from the multipurpose tray. The second conveyer path inclines to be lower toward the second side surface in a range between a merging point merging with the fourth conveyer path and the nip position between the paired registration rollers.

8 Claims, 2 Drawing Sheets

(56) References Cited

U.S. PATENT DOCUMENTS

| | | | | |
|---|---|---|---|---|
| 2009/0116889 | A1* | 5/2009 | Ishii | B41J 29/02 399/405 |
| 2011/0236100 | A1 | 9/2011 | Yamamoto | |
| 2012/0237279 | A1 | 9/2012 | Ichikawa | |
| 2015/0050045 | A1 | 2/2015 | Sato et al. | |
| 2016/0016741 | A1* | 1/2016 | Lee | B65H 1/266 271/10.09 |
| 2016/0363905 | A1* | 12/2016 | Wakimoto | G03G 21/1633 |

FOREIGN PATENT DOCUMENTS

| | | | |
|---|---|---|---|
| JP | 2007-264169 | A | 10/2007 |
| JP | 2012-188283 | A | 10/2012 |
| JP | 5051259 | B2 | 10/2012 |
| JP | 2015-036761 | A | 2/2015 |

* cited by examiner

IMAGE FORMING APPARATUS

CROSS REFERENCE TO RELATED APPLICATION

This application claims priority from Japanese Patent Application No. 2017-036037, filed on Feb. 28, 2017, the entire subject matter of which is incorporated herein by reference.

BACKGROUND

Technical Field

An aspect of the present disclosure is related to an electro-photographic image forming apparatus.

Related Art

An image forming apparatus, having a sheet conveyer path that curves in a shape of an S to extend from a feeder tray to an ejection tray, is known. A sheet may be conveyed in the sheet conveyer path while an image forming unit arranged along the sheet conveyer path forms an image on the sheet and thereafter ejected outside the image forming apparatus.

For example, a feeder tray may be arranged at a bottom of a housing of the image forming apparatus. A sheet may be picked up from the feeder tray to proceed frontward, and a direction to convey the sheet may turn rearward so that the sheet may be conveyed rearward. An image forming unit may be located along a part of the sheet conveyer path that extends rearward, and while the sheet is conveyed rearward in the sheet conveyer path, the image forming unit may form an image on the sheet. Thereafter, the sheet conveyer path may turn frontward so that the sheet with the image formed thereon may be conveyed frontward and ejected outside on an ejection tray, which is arranged on an upper side of the housing.

The image forming apparatus may additionally have a multipurpose tray, which is openable/closable at a frontward face of the housing. The multipurpose tray may support a stack of sheets thereon. A sheet picked up from the multipurpose tray may merge into the sheet conveyer path at a position upstream from the image forming unit to be conveyed at the image forming unit.

SUMMARY

In order to pick up and feed the sheets on the multipurpose tray separately one by one, a feeder system, including a feed roller and a separation roller, may be required. While the feed roller and the separation roller for the multipurpose tray may align side by side along a sheet conveying direction, a size of the image forming apparatus having the multipurpose tray may be increased in the aligning direction and in a direction of height.

The present disclosure is advantageous in that an image forming apparatus, which may be downsized while having a sheet conveyer path curving in an S-shape and a multipurpose tray, is provided.

According to an aspect of the present disclosure, an image forming apparatus, having a housing, a feeder tray, a multipurpose tray, a feeder, a process cartridge, a transfer member, and a registration roller pair, is provided. The housing includes a first side surface having an opening portion, a second side surface arranged on a side opposite of the first side surface, and an upper surface, on which an ejection tray is formed. The feeder tray is arranged at a lower position in the housing and is configured to support a first sheet. The multipurpose tray is arranged on a side of the first side surface and is configured to support a second sheet. The feeder includes a feed roller configured to contact an upper-side surface of the second sheet supported by the multipurpose tray, a separation roller arranged on a side closer to the second side surface with respect to the feed roller, and a separator member configured to contact the separation roller at a first nip position. The process cartridge is configured to be detachably attached to a predetermined position in the housing through the opening portion. The process cartridge includes a photosensitive drum. The transfer member is arranged to face the photosensitive drum and is configured to transfer a toner image carried on the photosensitive drum onto a sheet being one of the first sheet and the second sheet. The registration roller pair is configured to adjust timing to feed the sheet to the photosensitive drum. The registration roller pair defines a second nip position. The housing includes a first conveyer path, a second conveyer path, a third conveyer path, and a fourth conveyer path. The first conveyer path has a first U-shaped portion disposed downstream relatively to the feeder tray in a first sheet conveying direction, in which the first sheet is conveyed from the feeder tray. The second conveyer path is continuous with the first conveyer path and extends toward the second side surface through the second nip position and a position between the photosensitive drum and the transfer member. The third conveyer path is continuous with the second conveyer path and has a second U-shaped portion disposed downstream relatively to the second conveyer path in the sheet conveying direction to extend to the ejection tray. The fourth conveyer path extends from the multipurpose tray toward the second side surface and merges into the second conveyer path. The registration roller pair is arranged at a position, in which the second nip position is located to be lower than the first nip position, and in which a tangent that contacts circumferential surfaces of paired rollers in the registration roller pair at the second nip position inclines to be lower toward the second side surface. The second conveyer path inclines to be lower toward the second side surface in a range between a merging point merging with the fourth conveyer path and the second nip position.

BRIEF DESCRIPTION OF THE ACCOMPANYING DRAWINGS

DETAILED DESCRIPTION

Hereinafter, an embodiment of the present disclosure will be described with reference to the accompanying drawings.

<Overall Configuration of Laser Printer>

Figure 1:
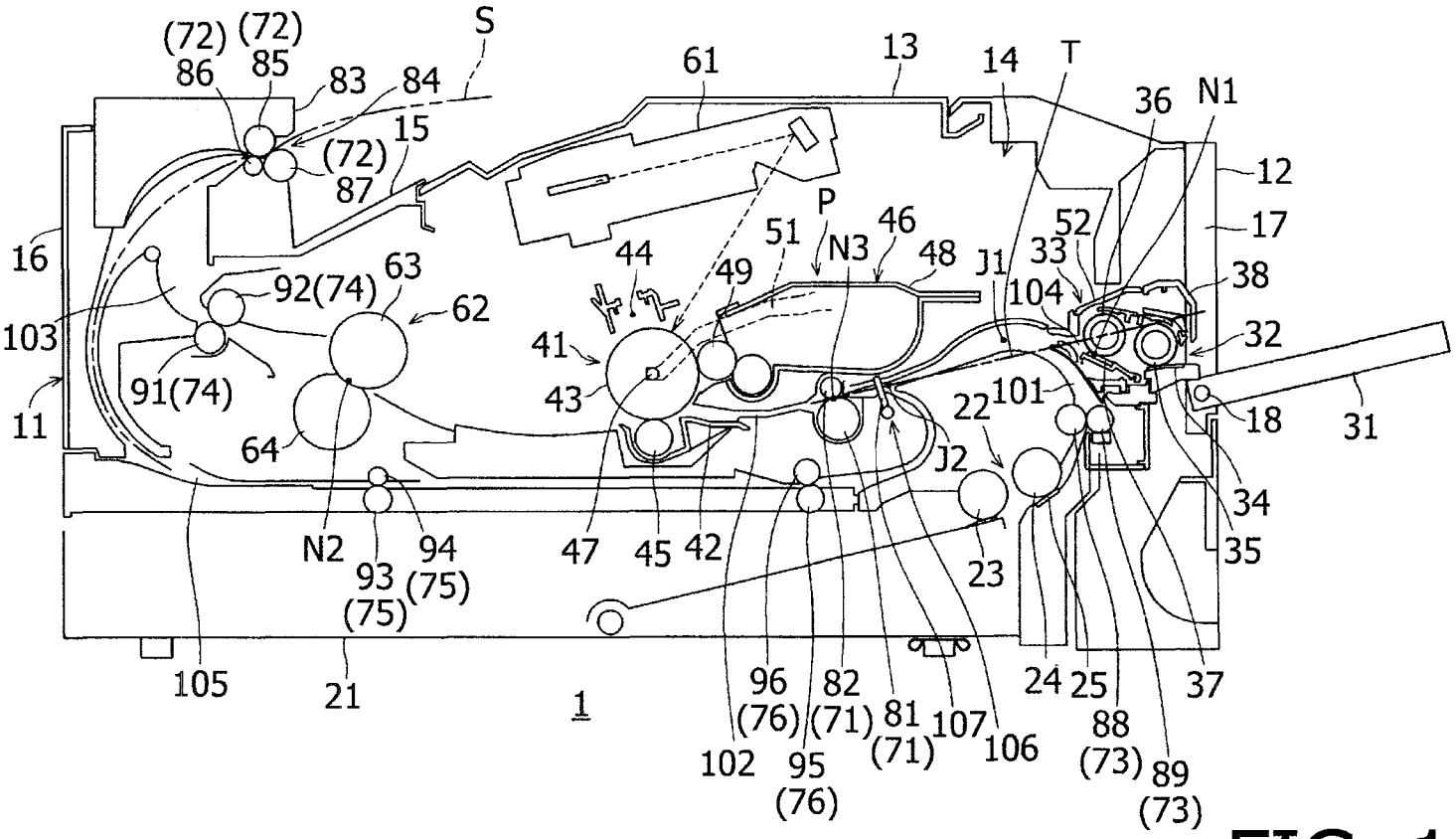
FIG. 1 is an illustrative cross-sectional view of a laser printer with a front cover at a closure position according to an embodiment of the present disclosure.
Figure 2:
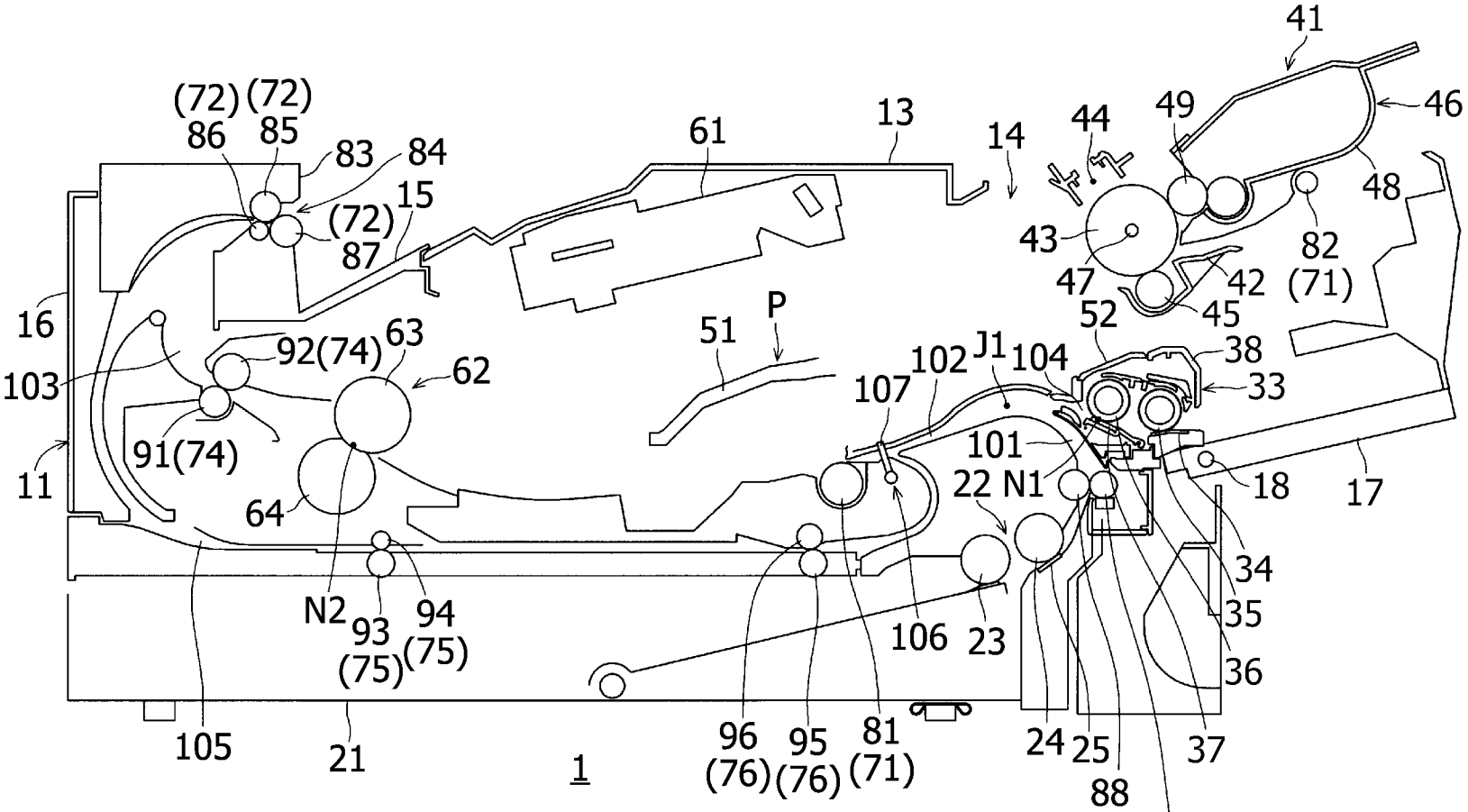
FIG. 2 is an illustrative cross-sectional view of the laser printer with the front cover at an open position according to the embodiment of the present disclosure.

A laser printer 1 shown in FIGS. 1-2 is a monochrome laser printer. The laser printer 1 includes a housing 11 having an approximate shape of a rectangular box. On a side surface 12 and on an upper surface 13 of the housing 11, continuously formed is an opening portion 14. On the upper surface 13, an ejection tray 15 is formed integrally with the upper surface 13.

In the following description, directions related the laser printer 1 and each part or item included in the laser printer 1 will be mentioned on basis of a user's position to ordinarily use the laser printer 1. For example, in FIG. 1, a viewer's right-hand side, on which the opening portion 14 is located, will be referred to as a front side, and a left-hand side, which is opposite from the front side, will be referred to as a rear side. In this regard, the side surface 12 may be a front face of the housing 11, and another side surface 16 opposite of the side surface 12 may be a rear face. Based on the user's position facing toward the side surface 12, a viewer's near side and farther side in FIGS. 1-2 will be referred to as a rightward side and a leftward side for the user to use the laser printer 1, respectively. An up-to-down or down-to-up direction in FIG. 1 may be referred to as a vertical direction, and a front-to-rear or rear-to-front direction may be referred to as a front-rear direction. Further, a left-to-right or right-to-left direction may be referred to as a widthwise direction.

To the housing 11, attached is a front cover 17, which may form the side surface 12. The front cover 17 may open or close the opening portion 14. The front cover 17 is pivotable about a pivot shaft 18, which is pivotaly held by the housing 11, to move between a closure position (see FIG. 1), in which the opening portion 14 is closed, and an open position (see FIG. 2), in which the front cover 17 is turned frontward to expose the opening portion 14.

At a lower position, e.g., a bottom, of the housing 11, arranged is a feeder tray 21, which is movable to be drawn outward and pushed inward. In other words, the feeder tray 21 may be attached to the housing 11 in an attached position (FIGS. 1 and 2) at the bottom of the housing 11 movably to be drawn frontward. The feeder tray 21 may support one or more sheets S in a stack thereon.

At an upper position with respect to a frontward end of the feeder tray 21, arranged is a first feeder 22. The first feeder 22 includes a feed roller 23, a separation roller 24, and a separator pad 25.

The feed roller 23 is rotatable about an axis, which extends in the widthwise direction. When the feeder tray 21 is at the attached position in the housing 11, a circumferential surface of the feed roller 23 may contact a frontward end area on an upper-side surface of a topmost sheet S in the sheets S stored in the feeder tray 21.

The separation roller 24 is arranged at a frontward position with respect to the feed roller 23 and is rotatable about an axis, which extends in the widthwise direction.

The separator pad 25 may contact a circumferential surface of the separation roller 24 at a lower-frontward position with respect to the separation roller 24 when the feeder tray 21 is at the attached position in the housing 11.

A multipurpose tray 31 is movably attached to the front cover 17 to move between an unusable position, in which the multipurpose tray 31 stands vertically along a frontward face of the front cover 17, and a usable position (see FIG. 1), in which the multipurpose tray 31 tilts to be higher frontward and lower rearward. The multipurpose tray 31 in the usable position may support one or more sheets S in a stack thereon. When the multipurpose tray 31 is in the usable position, a sheet inlet 32, through which an inside and an outside of the housing 11 are connected, is exposed.

On an inner side of, i.e., at a rearward position with respect to, the sheet inlet 32, arranged is a second feeder 33. The second feeder 33 includes a feeder pad 34, a feed roller 35, a separation roller 36, and a separator pad 37.

The feeder pad 34 is arranged at a rearward position with respect to a lower edge of the sheet inlet 32.

The feed roller 35 is arranged at an upper position with respect to the feeder pad 34 and is rotatable about an axis, which extends in the widthwise direction. The sheets S supported on the multipurpose tray 31 may lie over the multipurpose 31 and the separator pad 37, and a circumferential surface of the feed roller 35 may contact a rearward end area on an upper-side surface of a topmost sheet S in the sheets S lying over the separator pad 34.

The separation roller 36 is arranged at a rearward position with respect to the feed roller 35 and is rotatable about an axis, which extends in the widthwise direction.

The separator pad 37 is arranged to contact a circumferential surface of the separation roller 36 at a lower-rearward position with respect to the separator pad 37. At the position where the separator pad 37 contacts the separation roller 36, the separation roller 36 and the separator pad 37 define a nip position N1, where the sheet S may be nipped.

At an upper position with respect to the second feeder 33, arranged is a cover 38, which covers the feed roller 35 and the separation roller 36 from above. The cover 38 extends upward from a frontward position with respect to an upper end of the feed roller 35 and bends rearward to incline lower-rearward over the feed roller 35 and the separation roller 36.

In the housing 11, in a frontward area with respect to a center of the housing 11 in the front-rear direction, arranged at a cartridge-attachment position P is a process cartridge 41. The process cartridge 41 includes a cartridge frame 42 to hold a photosensitive drum 43, a charger 44, and a transfer roller 45. A developer device 46 may be detachably attached to the cartridge frame 42.

The photosensitive drum 43 includes a drum shaft 47, which extends in the widthwise direction. The drum shaft 47 is held rotatably by a rearward end portion of the cartridge frame 42. A leftward end and a rightward end of the drum shaft 47 protrude leftward and rightward, respectively, from the cartridge frame 42.

The charger 44 is arranged at an upper-rearward position with respect to the photosensitive drum 43. The charger 44 may be, for example, a scorotron charger having a wire and a grid.

The transfer roller 45 is arranged at a lower position with respect to the photosensitive drum 43 to face the photosensitive drum 43 vertically. The transfer roller 45 is rotatable about an axis, which extends in the widthwise direction.

The developer device 46 is arranged at a frontward position with respect to the photosensitive drum 43. The developer device 46 includes a developer housing 48 to contain toner and a developer roller 49 held by the developer housing 48. The developer roller 49 is rotatable about an axis, which extends in the widthwise direction. A circumferential surface of the developer roller 49 contacts a circumferential surface of the photosensitive drum 43.

The process cartridge 41 may be attached to the cartridge-attachment position P in the housing 11 and removed from the cartridge-attachment position P to be separated from the housing 11 through the opening portion 14 while the front cover 17 is open.

The housing 11 includes a leftward wall and a rightward wall (not shown), which face each other along the widthwise direction across the cartridge-attachment position P. On each of the leftward wall and the rightward wall, formed is a guide groove 51, which may guide the process cartridge 41 to be attached to and removed from the cartridge-attachment position P. The guide grooves 51 are formed to recess sideward in the widthwise direction and extends longitudinally to incline lower toward the rear and higher toward the front. The guide grooves 51 are open frontward and closed at rearward ends.

In order to attach the process cartridge 41 to the cartridge-attachment position P, the process cartridge 41 may be moved to enter the housing 11 through the opening portion 14, and the widthwise ends of the drum shaft 47 may be caught in the guide grooves 51 at the frontward ends of the guide grooves 51. As the process cartridge 14 is moved into the housing 11, the cartridge frame 42 may contact a guiding surface 52, which is formed on an upper side of the cover 38. The guiding surface 52 inclines to be lower at the rear and higher at the front, and the cartridge frame 42 may be guided along the guiding surface 52 on the cover 38. Meanwhile, the widthwise ends of the drum shaft 47 may be guided in the guide grooves 51. As the process cartridge 41 moves rearward, the widthwise ends of the drum shaft 47 may reach the rearward ends of the guide grooves 51 so that the process cartridge 41 reaches the cartridge-attachment position P, and the process cartridge 41 may be completely attached to the housing 11. While the widthwise ends of the drum shaft 47 are located at the rearward ends of the guide grooves 51, the drum shaft 47 is at a position lower than the nip position N1, which is between the separation roller 36 and the separator pad 37.

In order to remove the process cartridge 41 from the cartridge-attachment position P, the process cartridge 41 may be pulled frontward, and the widthwise ends of the drum shaft 47 may move frontward in the guide grooves 51. While the guide grooves 51 incline upper-frontward, the process cartridge 41 may move from the cartridge-attachment position P upper-frontward along the guide grooves 51. Once the widthwise ends of the drum shaft 47 exit frontward from the guide grooves 51, the cartridge frame 42 may contact and move along the guiding surface 52 on the cover 38, and the process cartridge 41 may be guided toward the opening portion 14. As the process cartridge 41 exits the housing 11 through the opening portion 14, the process cartridge 41 may be completely detached from the housing 41.

Inside the housing 11, at an upper position with respect to the cartridge-attachment position P, arranged is an exposure device 61. The exposure device 61 includes an optical system, including a laser emitter and polygon mirrors, to emit a laser beam at the photosensitive drum 43 according to image data. The laser beam emitted from the exposure device 61 may be, as indicated in a broken line in FIG. 1, transmitted through a position between the charger 44 and the developer device 46 at the circumferential surface of the photosensitive drum 43 while the process cartridge 41 is at the cartridge-attachment position P.

Inside the housing 11, further, at a rearward position with respect to the cartridge-attachment position P, arranged is a fuser 62. The fuser 62 includes a heating roller 63 and a pressing roller 64. The heating roller 63 is rotatable about an axis, which extends in the widthwise direction. The pressing roller 64 is arranged at a lower-rearward position with respect to the heating roller 63 and is rotatable about an axis, which extends in the widthwise direction. A circumferential surface of the pressing roller 64 contacts a circumferential surface of the heating roller 63. The heating roller 63 and the pressing roller 64 define a nip position N2, where the sheet S may be nipped.

Inside the housing 11, further, arranged are a registration roller pair 71, an ejection roller unit 72, a first conveyer roller pair 73, a second conveyer roller pair 74, a first reversing roller pair 75, and a second reversing roller pair 76.

The registration roller pair 71 is arranged at a frontward position with respect to the photosensitive drum 43 and the transfer roller 45. The registration roller pair 71 is arranged at a position spaced apart from the photosensitive drum 43 and the transfer roller 45 for a predetermined distance. The registration roller pair 71 includes a pair of rollers, which are a driving roller 81 and a driven roller 82. The driving roller 81 is held by the housing 11 rotatably to rotate about a shaft, which extends in the widthwise direction. The driven roller 82 is held by the cartridge frame 42 of the process cartridge 41 rotatably to rotate about an axis, which extends in the widthwise direction.

While the process cartridge 41 is at the cartridge-attachment position P, a circumferential surface of the driven roller 82 contacts an upper-rearward area of a circumferential surface of the driving roller 81. The registration roller pair 71 defines a nip position N3, where the sheet S may be nipped between the driving roller 81 and the driven roller 82. The nip position N3 is at a position lower than the nip position N1, which is between the separation roller 36 and the separator pad 37. A tangent T, which contacts both the driving roller 81 and the driven roller 82 at the position of the nip position N3, inclines to be lower at the rear and higher at the front. At least a part of the separation roller 36 is located to be lower than the tangent T.

The housing 11 includes a wall face 83, which extends upward from a rear end of the ejection tray 15. In the wall face 83, at an upper position spaced apart from the rear end of the ejection tray 15, formed is a sheet outlet 84, through which the sheet S may be ejected at the ejection tray 15. The ejection roller unit 72 is arranged at a rearward position with respect to the sheet outlet 84. The ejection roller unit 72 includes a driving roller 85 and two (2) driven rollers 86, 87. The driving roller 85 and the driven rollers 86, 87 are arranged to contact one another at circumferential surfaces and are rotatable about respective axes thereof, which extend in the widthwise direction.

The first conveyer roller pair 73 is arranged at an upper-frontward position with respect to the first feeder 22. The first conveyer roller pair 73 includes a pair of rollers, which are a driving roller 88 and a driven roller 89. The driving roller 88 and the driven roller 89 are arranged to contact each other at circumferential surfaces and are rotatable about respective axes thereof, which extend in the widthwise direction.

The second conveyer roller pair 74 is arranged at an upper-rearward position with respect to the fuser 62 and at a lower-rearward position with respect to the ejection roller unit 72. The second conveyer roller pair 74 includes a pair of rollers, which are a driving roller 91 and a driven roller 92. The driving roller 91 and the driven roller 92 are arranged to contact each other at circumferential surfaces thereof and are rotatable about respective axes thereof, which extend in the widthwise direction.

The first reversing roller pair 75 and the second reversing roller pair 76 are spaced apart from each other in the front-rear direction. The first reversing roller pair 75 is arranged between the feeder tray 21 and the fuser 62, and the second reversing roller pair 76 is arranged between the feeder tray 21 and the cartridge-attachment position P.

The first reversing roller pair 75, arranged rearward with respect to the second reversing roller pair 76, includes a pair of roller, which are a driving roller 93 and a driven roller 94. The driving roller 93 and the driven roller 94 are arranged to contact each other at circumferential surfaces and are rotatable about respective axes thereof, which extend in the widthwise direction.

The second reversing roller pair 76, arranged frontward with respect to the first reversing roller pair 75, includes a pair of rollers, which are a driving roller 95 and a driven roller 96. The driving roller 95 and the driven roller 96 are arranged to contact each other at circumferential surfaces and are rotatable about respective axes thereof, which extend in the widthwise direction.

In the housing 11, further, arranged are a first conveyer path 101, a second conveyer path 102, a third conveyer path 103, a fourth conveyer path 104, and a fifth conveyer path 105.

The first conveyer path 101 extends at a downstream position relatively to the feeder tray 21 in a sheet conveying direction, in which the sheet S may be conveyed from a position between the separation roller 24 and the separator pad 25 through a position between the driving roller 88 and the driven roller 89 in the first conveyer roller pair 73, curving upper-rearward in an approximate shape of "U." In other words, the first conveyer path 101 has a U-shaped portion disposed downstream relatively to the feeder tray 21 in the sheet conveying direction.

The second conveyer path 102 extends rearward continuously from the first conveyer path 101 through the nip position N3 between the driving roller 81 and the driven roller 82 in the registration roller pair 71, a position between the photosensitive drum 43 and the transfer roller 45, the nip position N2 between the heating roller 63 and the pressing roller 64 in the fuser 62, in this mentioned order.

The third conveyer path 103 extends upper-rearward continuously from the second conveyer path 102 through a position between the driving roller 91 and the driven roller 92 in the second conveyer roller pair 74. The third conveyer path 103 curves upper-frontward in an approximate shape of "U" at a position downstream relatively to the second conveyer path 102 in the sheet conveying direction and extends through the ejection roller unit 72 to the sheet outlet 84.

The fourth conveyer path 104 extends rearward from the sheet inlet 32 through a position between the feeder pad 34 and the feed roller 35 and the position of the nip position N1 between the separation roller 36 and the separator pad 37 in this mentioned order and merges with the second conveyer path 102 from the front at a merging point J1. The sheet S on the multipurpose tray 31 may be conveyed in the fourth conveyer path 104 to the merging point J1 in a conveying direction different from the sheet conveying direction, in which the sheet S from the feeder tray 21 may be conveyed; however, once the sheet S from the multipurpose tray 31 enters the second conveyer path 102 through the merging point J1, the sheet S may be conveyed in the same sheet conveying direction as the sheet S conveyed from the feeder tray 21. In other words, beyond the merging point J1, both the sheets S from the feeder tray 21 and from the multipurpose tray 31 may be conveyed in the same sheet conveying direction. The second conveyer path 102 inclines to be lower at the rear and higher at the front in a range between the merging point J1 and the nip position N3, which is between the driving roller 81 and the driven roller 82 in the registration roller pair 71.

The fifth conveyer path 105 branches off from the third conveyer path 103 at a position between the ejection roller unit 72 and the second conveyer roller pair 74, extends downward at a rearward area with respect to the third conveyer path 103, curves frontward, and extends through the first reversing roller pair 75 and the second reversing roller pair 76, in this mentioned order. The fifth conveyer path 105 merges with the second conveyer path 102 at a merging point J2. The merging point J2 is between the merging point J1, at which the fourth conveyer path 104 merges with the second conveyer path 102, and the registration roller pair 71.

At a position between the merging point J2 and the registration roller pair 71, interposed is an actuator 107 of a pre-registration sensor 106, which may detect the sheet S being conveyed thereto. The actuator 107 may be arranged to protrude upward into the second conveyer path 102 from a lower side of the second conveyer path 102.

<Actions in the Laser Printer>

A sheet S may be conveyed from a stack of sheets S on the feeder tray 21 or on the multipurpose tray 31 to be fed to the process cartridge 41 when the laser printer 1 prints an image on the sheet S.

In order to convey the sheet S from the feeder tray 21, the feed roller 23 in the first feeder 22 may rotate counterclockwise in a view from the left (see FIG. 1). As the feed roller 23 rotates, the sheet S being in contact with the circumferential surface of the feed roller 23 may be forwarded frontward. The sheet S from the feeder tray 21 may be forwarded through the position between the separation roller 24 and the separator pad 25 to be separated from other sheets S in the stack. The separated sheet S may enter the first conveyer path 101.

The sheet S entering the first conveyer path 101 may be subjected to a conveying force from the first conveyer roller pair 73 and proceed through the first conveyer path 101 curving in the U-shape to turn rearward and enter the second conveyer path 102.

The sheet S entering the second conveyer path 102 may proceed rearward in the second conveyer path 102. In the meantime, a leading edge of the sheet S may push the actuator 107 of the pre-registration sensor 106 rearward. Therefore, the pre-registration sensor 106 may detect the leading edge of the sheet S reaching the position of the actuator 107. When the leading edge of the sheet S reaches the position of the actuator 107, the registration roller pair 71 may not be rotating but may stay still. Therefore, when the leading edge of the sheet S reaches the nip position N3 between the paired registration rollers 71, the sheet S may be stopped to pause thereat.

Meanwhile, the photosensitive drum 43 may rotate clockwise in the view from the left (see FIG. 1). As the photosensitive drum 43 rotates, the surface of the photosensitive drum 43 may be charged evenly by the charger 44 and selectively exposed to the laser beam from the exposure device 61. Potential in areas on the surface of the photosensitive drum 43 exposed to the laser beam may be lowered to form an electrostatic latent image on the surface of the photosensitive drum 43. Thereafter, positively charged toner may be supplied by the developer roller 49 to the electrostatic latent image on the surface of the photosensitive drum 43 so that the electrostatic image may be developed to be a toner image and carried on the surface of the photosensitive drum 43.

Forming the toner image on the surface of the photosensitive drum 43 is synchronized with conveyance of the sheet S, and the registration roller pair 71 may start rotating at a predetermined timing to convey the sheet S so that the sheet S may reach the position between the photosensitive drum 43 and the transfer roller 45 when the toner image on the photosensitive drum 43 faces the transfer roller 45. Meanwhile, transfer bias is applied to the transfer roller 45.

Therefore, as the sheet S proceeds through the position between the photosensitive drum 43 and the transfer roller 45, the toner image may be transferred from the surface of the photosensitive drum 43 to an upper-side surface of the sheet S due to an effect of the transfer bias.

The sheet S with the toner image transferred thereon may proceed further rearward in the second conveyer path 102 to enter the fuser 62. In the fuser 62, the sheet S proceeds through the position between the heating roller 63 and the pressing roller 64 while the toner image may be fixed onto the sheet S by the heat and the pressure from the heating roller 63 and the pressing roller 64. With the heat and the pressure applied thereto, forming the image on the sheet S may be completed. The sheet S with the image formed thereon may exit the second conveyer path 102 and enter the third conveyer path 103.

The sheet S entering the third conveyer path 103 may be subjected to a conveying force from the second conveyer roller pair 74 and travels in the third conveyer path 103 for the ejection roller unit 72.

The laser printer 1 may perform a single-face printing, in which an image may be formed solely on one side of the sheet S, and a double-face printing, in which images may be formed on both sides of the sheet S.

In a single-face printing operation, the sheet S with the image formed on one side may be subjected to a conveying force from the ejection roller unit 72 acting in a direction toward the ejection tray 15 and may be ejected outside the housing 11 through the sheet outlet 84 to rest on the ejection tray 15. Thus, the sheet S conveyed from the feeder tray 21 may travel in a course that curves in the shape of S through the first conveyer path 101, the second conveyer path 102, and the third conveyer path 103 while the image is formed on the one side of the sheet S during the travel, and the sheet S with the image formed thereon may be ejected and released in the ejection tray 15.

In a double-face printing operation, the sheet S with the image formed on one side may be subjected to the conveying force from the ejection roller unit 72 acting in the direction toward the rejection tray 15 to be ejected partly through the sheet outlet 84 until a trailing portion, i.e., a rearward portion, of the sheet S may be nipped by the ejection roller unit 72. While the trailing portion of the sheet S is nipped by the ejection roller unit 72, a rotating direction of the driving roller 85 in the ejection roller unit 72 may be reversed. Thereby, the sheet S may now be subjected to a conveying force from the ejection roller unit 72 acting in a direction opposite from the ejection tray 15, and the sheet S may be pulled backward inside the housing 11 to enter the fifth conveyer path 105 without being released in the ejection tray 15.

The sheet S entering the fifth conveyer path 105 may be subjected to conveying forces from the first reversing roller pair 75 and the second reversing roller pair 76 to travel frontward in the fifth conveyer path 105 and enter the second conveyer path 102 through the merging point J2. Thereby, the sheet S may be reversed upside down so that the one side with the image having been formed may face downward and the other side with no image being formed yet may face upward. The reversed sheet S may proceed in the second conveyer path 102 toward the photosensitive drum 43 so that another image may be formed on the other side of the sheet S, in the same manner as the image was formed on the one side of the sheet S. The sheet S with the images formed on both sides may be conveyed by the conveying force from the ejection roller unit 72 and ejected to be released in the ejection tray 15.

In order to feed the sheet S from a stack of sheets S on the multipurpose tray 31, the feed roller 35 in the second feeder 33 may rotate counterclockwise in the view from the left (see FIG. 1). As the feed roller 35 rotates, the sheet S being in contact with the circumferential surface of the feed roller 35 may be conveyed rearward. The sheet S from the multipurpose tray 31 may be conveyed through the position between the separation roller 36 and the separator pad 37 to be separated from other sheets S in the stack. The separated sheet S may enter and proceed in the fourth conveyer path 104 toward the second conveyer path 102 and enter the second conveyer path 102 through the merging point J2. The sheet S entering the second conveyer path 102 may proceed rearward in the second conveyer path 102, and an image or images may be formed on one side or both sides of the sheet S, in the same manner as the sheet S fed from the feeder tray 21. The sheet S with the image(s) formed thereon may travel in the third conveyer path 103 and may be ejected and released in the ejection tray 15.

<Benefits>

According to the embodiment described above, the laser printer 1 has the feeder tray 21 at the bottom of the housing 11. In the housing 11, arranged are the first conveyer path 101, the second conveyer path 102, the third conveyer path 103, and the fourth conveyer path 104. The sheet S fed from the feeder tray 21 may travel in the S-shaped course including the first conveyer path 101, the second conveyer path 102, and the third conveyer path 103. Meanwhile, the sheet S fed from the multipurpose tray 31 may enter the second conveyer path 102 through the fourth conveyer path 104 and travel in the second conveyer path 102 and the third conveyer path 103. The second conveyer path 102 extends through the position between the photosensitive drum 43 and the transfer roller 45; therefore, when the sheet S in the second conveyer path 102 travels through the position between the photosensitive drum 43 and the transfer roller 45, the toner image carried on the photosensitive drum 43 may be transferred onto the sheet S.

Meanwhile, at the position upstream from the photosensitive drum 43 in the sheet conveying direction, arranged is the registration roller pair 71 to adjust the timing to feed the sheet S to the photosensitive drum 43. Since the second conveyer path 102 inclines lower-rearward in the range between the merging point J1 to merge with the fourth conveyer path 104 and the nip position N3 in the registration roller pair 71, a relatively large volume of space in the vertical direction may be reserved in an area around the registration roller pair 71, and in the reserved space, the process cartridge 41 containing the photosensitive drum 43 may be located. Meanwhile, a motion path, in which the process cartridge 41 may be attached to or detached from the cartridge-attachment position P in the reserved space, may be arranged to incline lower-rearward and upper-frontward. Therefore, a certain volume of space may be reserved at an upper position with respect to the multipurpose tray 31 within the housing 11 to accommodate the second feeder 33 including the feed roller 35, the separation roller 36, and the separator pad 37. Meanwhile, the second feeder arranged in the reserved space may not necessarily interfere with the process cartridge 41 being attached to or detached from the housing 11.

Thus, an entire size of the laser printer 1, having the S-shaped conveyer path and the multipurpose tray 31, may be reduced.

The tangent T contacting both the driving roller 81 and the driven roller 82 at the position of the nip position N3 inclines to be lower at the rear and higher at the front, and the part of the separation roller 36 is located to be lower than the tangent T. In this regard, a certain volume of space may be reserved in the upper area with respect to the separation roller 36. Therefore, the second feeder 33 including the separation roller 36 may be effectively prevented from interfering with the process cartridge 41 being attached to or detached from the housing 11.

The laser printer 1 has the cover 38 that covers the feed roller 35 and the separation roller 36 from above. The upper surface of the cover 38 provides the guiding surface 52, which may contact and guide the process cartridge 41 being attached to or detached from the housing 11. Therefore, the process cartridge 41 may be easily attached to and detached from the cartridge-attachment position P along the guiding surface 52.

The housing 11 has the guide grooves 51, which may guide the process cartridge 41 to be attached to or detached from the cartridge-attachment position P, inclining to be lower at the rear and higher at the front. With the guide grooves 51 to guide the process cartridge 41, the process cartridge 41 may be attached to or detached from the cartridge-attachment position P more easily.

When the process cartridge 41 is at the cartridge-attachment position P, the drum shaft 47 being a rotation axis of the photosensitive drum 43 is at the position lower than the nip position N1 between the separation roller 36 and the separator pad 37. Therefore, a volume of space to arrange the exposure device 61 may be reserved at the upper area with respect to the photosensitive drum 43 so that a vertical dimension of the laser printer 1 may be reduced.

While the nip position N2 between the heating roller 63 and the pressing roller 64 in the fuser 62 may be at the position lower than the nip position N1 between the separation roller 36 and the separator pad 37, a large part of the fuser 62 may be arranged an approximately same vertical position as the separation roller 36 and the separator pad 37. Therefore, the vertical dimension of the laser printer 1 may be reduced even more effectively.

The pre-registration sensor 106 with the actuator 107, which protrudes into the second conveyer path 102 from below, is arranged at the frontward position with respect to the registration roller pair 71. Meanwhile, the second conveyer path 102 inclines to be lower at the rear and higher at the front in the range between the merging point J1 to merge with the fourth conveyer path 104 and the nip position N3 in the registration pair 71. Therefore, the sheet S conveyed from the multipurpose tray 31 may effectively contact the actuator 107 so that the sheet S may be prevented from climbing over the actuator 107 without pushing down the actuator 107. Therefore, the pre-registration roller 106 may detect the leading edge of the sheet S reaching the registration roller pair 71 accurately.

<More Examples>

Although an example of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the present disclosure may not necessarily be embodied in the laser printer 1 but may be embodied in another style of image forming apparatus such as, for example, an inkjet printer.

What is claimed is:

1. An image forming apparatus, comprising:

a housing comprising a first side surface having an opening portion, a second side surface arranged on a side opposite of the first side surface, and an upper surface, on which an ejection tray is formed;

a feeder tray arranged at a lower position in the housing, the feeder tray being configured to support a first sheet;

a multipurpose tray arranged on a side of the first side surface, the multipurpose tray being configured to support a second sheet;

a feeder comprising a feed roller configured to contact an upper-side surface of the second sheet supported by the multipurpose tray, a separation roller arranged on a side closer to the second side surface with respect to the feed roller, and a separator member configured to contact the separation roller at a first nip position;

a process cartridge configured to be detachably attached to a predetermined position in the housing through the opening portion, the process cartridge comprising a photosensitive drum;

a transfer member arranged to face the photosensitive drum, the transfer member being configured to transfer a toner image carried on the photosensitive drum onto a sheet being one of the first sheet and the second sheet; and a registration roller pair configured to adjust timing to feed the sheet to the photosensitive drum, the registration roller pair defining a second nip position, wherein the housing includes a first conveyer path having a first U-shaped portion disposed downstream relatively to the feeder tray in a sheet conveying direction, in which the first sheet is conveyed from the feeder tray, a second conveyer path continuous with the first conveyer path, the second conveyer path extending toward the second side surface through the second nip position and a position between the photosensitive drum and the transfer member, a third conveyer path continuous with the second conveyer path, the third conveyer path having a second U-shaped portion disposed downstream relatively to the second conveyer path in the sheet conveying direction and extending to the ejection tray, and a fourth conveyer path extending from the multipurpose tray toward the second side surface, the fourth conveyer path merging into the second conveyer path;

wherein the registration roller pair is arranged at a position, in which the second nip position is located to be lower than the first nip position, and in which a tangent that contacts circumferential surfaces of paired rollers in the registration roller pair at the second nip position inclines to be lower toward the second side surface;

wherein the separation roller overlaps the tangent in a side view, and a part of the separation roller is located to be lower than the tangent; and wherein the second conveyer path inclines to be lower toward the second side surface in a range between a merging point merging with the fourth conveyer path and the second nip position.

2. The image forming apparatus according to claim 1, further comprising a cover configured to cover the feed roller and the separation roller from above, wherein the cover includes a guiding surface formed on an upper side thereof, the guiding surface being configured to contact and guide the process cartridge being detachably attached to the predetermined position in the housing.

3. The image forming apparatus according to claim 1, wherein the housing includes a guide groove configured to guide the process cartridge being detachably attached to the predetermined position in the housing, the guide groove inclining to be lower toward the second side surface.

4. The image forming apparatus according to claim 1, wherein the photosensitive drum is arranged at a position, in which a rotation axis of the photosensitive drum is located to be lower than the first nip position.

5. The image forming apparatus according to claim 1, further comprising a heater; and a pressor arranged to face the heater, the pressor contacting the heater at a third nip position, wherein the heater and the pressor are arranged at positions, in which the third nip position is located to be lower than the first nip position.

6. The image forming apparatus according to claim 1, wherein the housing includes a fifth conveyer path, in which the sheet with the toner image transferred on one side thereof travels, the fifth conveyer path branching off from the third conveyer path and extending toward the second conveyer path, the fifth conveyer path merging into the second conveyer path at a position closer to the first side surface with respect to the registration roller pair.

7. The image forming apparatus according to claim 1, wherein one of the paired rollers in the registration roller pair arranged at an upper position is held by the process cartridge.

8. The image forming apparatus according to claim 1, further comprising a pre-registration sensor arranged to be closer to the first side surface with respect to the registration roller pair, the pre-registration sensor comprising an actuator arranged to protrude into the second conveyer path from a lower side with respect to the second conveyer path.

* * * * *